US009812147B2

(12) United States Patent
Kechichian et al.

(10) Patent No.: US 9,812,147 B2
(45) Date of Patent: Nov. 7, 2017

(54) SYSTEM AND METHOD FOR GENERATING AN AUDIO SIGNAL REPRESENTING THE SPEECH OF A USER

(75) Inventors: Patrick Kechichian, Eindhoven (NL); Wilhelmus Andreas Martinus Arnoldus Maria Van Den Dungen, Boxtel (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 262 days.

(21) Appl. No.: 13/988,142

(22) PCT Filed: Nov. 17, 2011

(86) PCT No.: PCT/IB2011/055149

§ 371 (c)(1),
(2), (4) Date: May 17, 2013

(87) PCT Pub. No.: WO2012/069966

PCT Pub. Date: May 31, 2012

(65) Prior Publication Data

US 2013/0246059 A1 Sep. 19, 2013

(30) Foreign Application Priority Data

Nov. 24, 2010 (EP) ..... 10192409

(51) Int. Cl.
*G10L 21/0208* (2013.01)

(52) U.S. Cl.
CPC ..... *G10L 21/0208* (2013.01)

(58) Field of Classification Search
CPC ..... G10L 21/0208
(Continued)

(56) References Cited

U.S. PATENT DOCUMENTS 5,602,959 A * 2/1997 Bergstrom ..... G10L 19/10 704/203
7,499,686 B2 3/2009 Sinclair et al.
(Continued)

FOREIGN PATENT DOCUMENTS

CH EP 1640972 A1 * 3/2006 ..... G10L 21/0272
CN 101015001 A 8/2007
(Continued)

OTHER PUBLICATIONS

"Linear Prediction Analysis (Theory)", retreived from http://iitg.vlab.co.in/?sub=59&brch=164&sim=616&cnt=1108 on Aug. 10, 2016.*
(Continued)

*Primary Examiner* — Edwin S Leland, III

(57) ABSTRACT

There is provided a method of generating a signal representing the speech of a user, the method comprising obtaining a first audio signal representing the speech of the user using a sensor in contact with the user; obtaining a second audio signal using an air conduction sensor, the second audio signal representing the speech of the user and including noise from the environment around the user; detecting periods of speech in the first audio signal; applying a speech enhancement algorithm to the second audio signal to reduce the noise in the second audio signal, the speech enhancement algorithm using the detected periods of speech in the first audio signal; equalizing the first audio signal using the noise-reduced second audio signal to produce an output audio signal representing the speech of the user.

15 Claims, 10 Drawing Sheets

(58) Field of Classification Search
USPC ..... 704/225
See application file for complete search history.

(56) References Cited

U.S. PATENT DOCUMENTS

| | | | | | |
|---|---|---|---|---|---|
| 8,078,459 | B2 * | 12/2011 | Dai | G10L 19/24 | 704/201 |
| 8,370,136 | B2 * | 2/2013 | Dai | G10L 19/012 | 704/226 |
| 2001/0002930 | A1 * | 6/2001 | Kates | H04R 25/453 | 381/317 |
| 2003/0063763 | A1 * | 4/2003 | Allred | H04R 25/70 | 381/314 |
| 2004/0172252 | A1 * | 9/2004 | Aoki | H04M 3/564 | 704/270 |
| 2005/0114124 | A1 * | 5/2005 | Liu | G10L 21/0208 | 704/228 |
| 2005/0185813 | A1 * | 8/2005 | Sinclair | G10L 21/0208 | 381/380 |
| 2006/0079291 | A1 * | 4/2006 | Granovetter | G06F 17/289 | 455/563 |
| 2007/0160254 | A1 * | 7/2007 | Ritter | G02C 11/06 | 381/381 |
| 2007/0230712 | A1 * | 10/2007 | Belt | G10L 21/0208 | 381/71.1 |
| 2008/0270126 | A1 * | 10/2008 | Jung | G10L 25/93 | 704/222 |
| 2009/0080666 | A1 * | 3/2009 | Uhle | H04R 5/04 | 381/17 |
| 2009/0177474 | A1 * | 7/2009 | Morita | G10L 13/07 | 704/260 |
| 2009/0201983 | A1 * | 8/2009 | Jasiuk | G10L 21/038 | 375/240 |
| 2010/0042416 | A1 * | 2/2010 | Wan | G10L 19/24 | 704/500 |
| 2010/0280823 | A1 * | 11/2010 | Shlomot | G10L 19/012 | 704/201 |
| 2012/0084084 | A1 * | 4/2012 | Zhu | G10L 21/0208 | 704/233 |
| 2012/0316881 | A1 * | 12/2012 | Kato | G10L 13/08 | 704/260 |
| 2013/0070935 | A1 * | 3/2013 | Hui | G10K 11/16 | 381/71.1 |
| 2014/0119548 | A1 * | 5/2014 | Kechichian | H04R 3/005 | 381/56 |
| 2014/0330557 | A1 * | 11/2014 | Huber | A61F 5/58 | 704/225 |

FOREIGN PATENT DOCUMENTS

| | | | | | |
|---|---|---|---|---|---|
| EP | 1569422 | | 8/2005 | | |
| EP | 1569422 | A2 * | 8/2005 | G10L 21/0208 | |
| EP | 1640972 | | 12/2005 | | |
| EP | 1640972 | A1 * | 3/2006 | G10L 21/0272 | |
| JP | 04245720 | A * | 9/1992 | | |
| JP | H04245720 | A | 9/1992 | | |
| JP | 05333899 | A * | 12/1993 | | |
| JP | H05333899 | A | 12/1993 | | |
| JP | 2004279768 | A | 10/2004 | | |
| JP | 2004279768 | A * | 10/2004 | | |
| JP | 2007240654 | A * | 9/2007 | | |
| JP | 2007531029 | A | 11/2007 | | |
| KR | 2003040610 | A | 5/2003 | | |
| WO | 2006027707 | A1 | 3/2006 | | |
| WO | WO 2006027707 | A1 * | 3/2006 | G10L 21/0208 | |

OTHER PUBLICATIONS

K. Kondo et al, "On Equalization of Bone Conducted Speech for Improved Speech Quality", 2006 IEEE International Symposium on Signal Processing and Information Technology, Aug. 1, 2006, pp. 426-431.

T.T. Vu et al, "An LP-Based Blind Model for Restoring Bone-Conducted Speech", Communications and Electronics, 2008, ICCE 2008, Jun. 4, 2008, 2nd International Conference on IEEE, Piscataway, NJ, USA, pp. 212-217.

Boll: "Suppression of Acoustic Noise in Speech Using Spectral Subtraction": IEEE Transactions on Acoustics, Speech, and Signal Processing, vol. ASSP-27. pp. 113-120, 2007.

Liu et al: "Direct Filtering for Air-And Bone-Conductive Microphones"; IEEE 6th Workshop on Multimedia Signal Processing, pp. 363-366. 2004.

Makhoul: "Linear Prediction: A Tutorial Review"; Proceedings of the IEEE, vol. 63, No. 4, Apr. 1975, pp. 561-580.

Martin: "Spectral Subtraction Based on Minimun Statistics"; Signal Processing VII, Proc. EUSIPCO, Edinburgh, Scotland, Sep. 1994, pp. 1182-1185.

Isvan: "Noise Reduction Method by Which a Primary Input Signal";Paper Published Apr. 2004.

Shimamura et al: "A Reconstruction Filter for Bone-Conducted Speech"; IEEE 48th Midwest Symposium on Circuits and Systems, vol. 2, pp. 1847-1850.

Viswanathan et al: "Multisensor Speech Input for Enhanced Immunity to Acoustic Background Noise"; IEEE International Conference on Acoustics, Speech, and Signal Processing, Mar. 1984, vol. 9, pp. 57-60.

Vu et al: "A Study on an LP-Based Model for Restoring Bone-Conducted Speech"; IEEE First International Conference on Communications and Electronics, Nov. 2006, pp. 294-299.

Zhu et al: "A Robust Speech Enhancement Scheme on the Basis of Bone-Conductive Microphones"; IEEE 3rd International Workshop on Signal Design and It's Applications in Communications, Dec. 2007, pp. 353-355.

Moser et al: "Relative Intensities of Sounds At Various Anatomical Locations of the Head and Neck During Phonation of the Vowels"; The Journal of the Acoustical Society of America, vol. 30, No. 4, Apr. 1958, pp. 275-277.

Sambur et al; "LPC Analysis/Synthesis from Speech Inputs Containing Quantizng Noise or Additive White Noise"; IEEE Transactions on Acoustics, Speech and Signal Processing, vol. 24, No. 6, pp. 488-494, Dec. 1976.

* cited by examiner

SYSTEM AND METHOD FOR GENERATING AN AUDIO SIGNAL REPRESENTING THE SPEECH OF A USER

TECHNICAL FIELD OF THE INVENTION

The invention relates to a system and method for producing an audio signal, and in particular to a system and method for producing an audio signal representing the speech of a user from an audio signal obtained using a contact sensor such as a bone-conducting or contact microphone.

BACKGROUND TO THE INVENTION

Mobile devices are frequently used in acoustically harsh environments (i.e. environments where there is a lot of background noise). Aside from problems with a user of the mobile device being able to hear the far-end party during two-way communication, it is difficult to obtain a 'clean' (i.e. noise free or substantially noise-reduced) audio signal representing the speech of the user. In environments where the captured signal-to-noise ratio (SNR) is low, traditional speech processing algorithms can only perform a limited amount of noise suppression before the near-end speech signal (i.e. that obtained by the microphone in the mobile device) can become distorted with 'musical tones' artifacts.

It is known that audio signals obtained using a contact sensor, such as a bone-conducted (BC) or contact microphone (i.e. a microphone in physical contact with the object producing the sound) are relatively immune to background noise compared to audio signals obtained using an air-conducted (AC) sensor, such as a microphone (i.e. a microphone that is separated from the object producing the sound by air), since the sound vibrations measured by the BC microphone have propagated through the body of the user rather than through the air as with a normal AC microphone, which, in addition to capturing the desired audio signal, also picks up the background noise. Furthermore, the intensity of the audio signals obtained using a BC microphone is generally much higher than that obtained using an AC microphone. Therefore, BC microphones have been considered for use in devices that might be used in noisy environments. FIG. 1 illustrates the high SNR properties of an audio signal obtained using a BC microphone relative to an audio signal obtained using an AC microphone in the same noisy environment.

However, the problem with speech obtained using a BC microphone is that its quality and intelligibility are usually much lower than speech obtained using an AC microphone. This reduction in intelligibility generally results from the filtering properties of bone and tissue, which can severely attenuate the high frequency components of the audio signal.

The quality and intelligibility of the speech obtained using a BC microphone depends on its specific location on the user. The closer the microphone is placed near the larynx and vocal cords around the throat or neck regions, the better the resulting quality and intensity of the BC audio signal. Furthermore, since the BC microphone is in physical contact with the object producing the sound, the resulting signal has a higher SNR compared to an AC audio signal which also picks up background noise.

However, although speech obtained using a BC microphone placed in or around the neck region will have a much higher intensity, the intelligibility of the signal will still be quite low, which is attributed to the filtering of the glottal signal through the bones and soft tissue in and around the neck region and the lack of the vocal tract transfer function.

The characteristics of the audio signal obtained using a BC microphone also depend on the housing of the BC microphone, i.e. is it shielded from background noise in the environment, as well as the pressure applied to the BC microphone to establish contact with the user's body.

Filtering or speech enhancement methods exist that aim to improve the intelligibility of speech obtained from a BC microphone, but these methods require either the presence of a clean speech reference signal in order to construct an equalization filter for application to the audio signal from the BC microphone, or the training of user-specific models using a clean audio signal from an AC microphone. As a result, these methods are not suited to real-world applications where a clean speech reference signal is not always available (for example in noisy environments), or where any of a number of different users can use a particular device.

Therefore, there is a need for an alternative system and method for producing an audio signal representing the speech of a user from an audio signal obtained using a BC microphone that can be used in noisy environments and that does not require the user to train the algorithm before use.

SUMMARY OF THE INVENTION

According to a first aspect of the invention, there is provided a method of generating a signal representing the speech of a user, the method comprising obtaining a first audio signal representing the speech of the user using a sensor in contact with the user; obtaining a second audio signal using an air conduction sensor, the second audio signal representing the speech of the user and including noise from the environment around the user; detecting periods of speech in the first audio signal; applying a speech enhancement algorithm to the second audio signal to reduce the noise in the second audio signal, the speech enhancement algorithm using the detected periods of speech in the first audio signal; equalizing the first audio signal using the noise-reduced second audio signal to produce an output audio signal representing the speech of the user.

This method has the advantage that although the noise-reduced AC audio signal might still contain noise and/or artifacts, it can be used to improve the frequency characteristics of the BC audio signal (which generally does not contain speech artifacts) so that it sounds more intelligible.

Preferably, the step of detecting periods of speech in the first audio signal comprises detecting parts of the first audio signal where the amplitude of the audio signal is above a threshold value.

Preferably, the step of applying a speech enhancement algorithm comprises applying spectral processing to the second audio signal.

In a preferred embodiment, the step of applying a speech enhancement algorithm to reduce the noise in the second audio signal comprises using the detected periods of speech in the first audio signal to estimate the noise floors in the spectral domain of the second audio signal.

In preferred embodiments, the step of equalizing the first audio signal comprises performing linear prediction analysis on both the first audio signal and the noise-reduced second audio signal to construct an equalization filter.

In particular, the step of performing linear prediction analysis preferably comprises (i) estimating linear prediction coefficients for both the first audio signal and the noise-reduced second audio signal; (ii) using the linear prediction coefficients for the first audio signal to produce an excitation signal for the first audio signal; (iii) using the linear prediction coefficients for the noise-reduced second audio signal to construct a frequency domain envelope; and (iv) equalizing the excitation signal for the first audio signal using the frequency domain envelope.

Alternatively, the step of equalizing the first audio signal comprises (i) using long-term spectral methods to construct an equalization filter, or (ii) using the first audio signal as an input to an adaptive filter that minimizes the mean-square error between the filter output and the noise-reduced second audio signal.

In some embodiments, prior to the step of equalizing, the method further comprises the step of applying a speech enhancement algorithm to the first audio signal to reduce the noise in the first audio signal, the speech enhancement algorithm making use of the detected periods of speech in the first audio signal, and wherein the step of equalizing comprises equalizing the noise-reduced first audio signal using the noise-reduced second audio signal to produce the output audio signal representing the speech of the user.

In particular embodiments, the method further comprises the steps of obtaining a third audio signal using a second air conduction sensor, the third audio signal representing the speech of the user and including noise from the environment around the user; and using a beamforming technique to combine the second audio signal and the third audio signal and produce a combined audio signal; and wherein the step of applying a speech enhancement algorithm comprises applying the speech enhancement algorithm to the combined audio signal to reduce the noise in the combined audio signal, the speech enhancement algorithm using the detected periods of speech in the first audio signal.

In particular embodiments, the method further comprises the steps of obtaining a fourth audio signal representing the speech of a user using a second sensor in contact with the user; and using a beamforming technique to combine the first audio signal and the fourth audio signal and produce a second combined audio signal; and wherein the step of detecting periods of speech comprises detecting periods of speech in the second combined audio signal.

According to a second aspect of the invention, there is provided a device for use in generating an audio signal representing the speech of a user, the device comprising processing circuitry that is configured to receive a first audio signal representing the speech of the user from a sensor in contact with the user; receive a second audio signal from an air conduction sensor, the second audio signal representing the speech of the user and including noise from the environment around the user; detect periods of speech in the first audio signal; apply a speech enhancement algorithm to the second audio signal to reduce the noise in the second audio signal, the speech enhancement algorithm using the detected periods of speech in the first audio signal; and equalize the first audio signal using the noise-reduced second audio signal to produce an output audio signal representing the speech of the user.

In preferred embodiments, the processing circuitry is configured to equalize the first audio signal by performing linear prediction analysis on both the first audio signal and the noise-reduced second audio signal to construct an equalization filter.

In preferred embodiments, the processing circuitry is configured to perform the linear prediction analysis by (i) estimating linear prediction coefficients for both the first audio signal and the noise-reduced second audio signal; (ii) using the linear prediction coefficients for the first audio signal to produce an excitation signal for the first audio signal; (iii) using the linear prediction coefficients for the noise-reduced audio signal to construct a frequency domain envelope; and (iv) equalizing the excitation signal for the first audio signal using the frequency domain envelope.

Preferably, the device further comprises a contact sensor that is configured to contact the body of the user when the device is in use and to produce the first audio signal; and an air-conduction sensor that is configured to produce the second audio signal.

According to a third aspect of the invention, there is provided a computer program product comprising computer readable code that is configured such that, on execution of the computer readable code by a suitable computer or processor, the computer or processor performs the method described above.

BRIEF DESCRIPTION OF THE DRAWINGS

Exemplary embodiments of the invention will now be described, by way of example only, with reference to the following drawings, in which.

DETAILED DESCRIPTION OF THE PREFERRED EMBODIMENTS

As described above, the invention addresses the problem of providing a clean (or at least intelligible) speech audio signal from a poor acoustic environment where the speech is either degraded by severe noise or reverberation.

Existing algorithms developed for the equalization of audio signals obtained using a BC microphone or contact sensor (to increase the naturalness of the speech) rely on the use of a clean reference signal or the prior training of a user-specific model, but the invention provides an improved system and method for generating an audio signal representing the speech of a user from an audio signal obtained from a BC or contact microphone that can be used in noisy environments and that does not require the user to train the algorithm before use.

Figure 1:
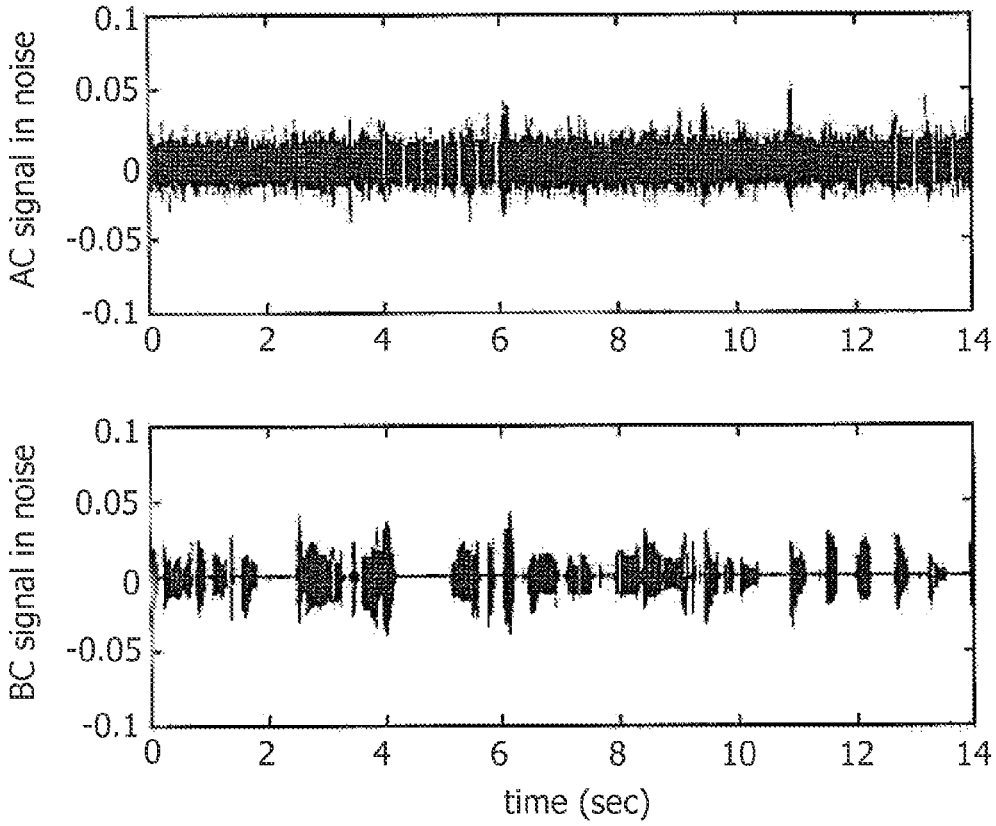
FIG. 1 illustrates the high SNR properties of an audio signal obtained using a BC microphone relative to an audio signal obtained using an AC microphone in the same noisy environment.

A device 2 including processing circuitry according to a first embodiment of the invention is shown in FIG. 1. The device 2 may be a portable or mobile device, for example a mobile telephone, smart phone or PDA, or an accessory for such a mobile device, for example a wireless or wired hands-free headset.

The device 2 comprises two sensors 4, 6 for producing respective audio signals representing the speech of a user. The first sensor 4 is a bone-conducted or contact sensor that is positioned in the device 2 such that it is in contact with a part of the user of the device 2 when the device 2 is in use, and the second sensor 6 is an air-conducted sensor that is generally not in direct physical contact with the user. In the illustrated embodiments, the first sensor 4 is a bone-conducted or contact microphone and the second sensor is an air-conducted microphone. In alternative embodiments, the first sensor 4 can be an accelerometer that produces an electrical signal that represents the accelerations resulting from the vibration of the user's body as the user speaks. Those skilled in the art will appreciate that the first and/or second sensors 4, 6 can be implemented using other types of sensor or transducer.

The BC microphone 4 and AC microphone 6 operate simultaneously (i.e. they capture the same speech at the same time) to produce a bone-conducted and air-conducted audio signal respectively.

The audio signal from the BC microphone 4 (referred to as the "BC audio signal" below and labeled "$m_1$" in FIG. 2) and the audio signal from the AC microphone 6 (referred to as the "AC audio signal" below and labeled "$m_2$" in FIG. 2) are provided to processing circuitry 8 that carries out the processing of the audio signals according to the invention.

The output of the processing circuitry 8 is a clean (or at least improved) audio signal representing the speech of the user, which is provided to transmitter circuitry 10 for transmission via antenna 12 to another electronic device.

The processing circuitry 8 comprises a speech detection block 14 that receives the BC audio signal, a speech enhancement block 16 that receives the AC audio signal and the output of the speech detection block 14, a first feature extraction block 18 that receives the BC audio signal, a second feature extraction block 20 that receives the output of the speech enhancement block 16 and an equalizer 22 that receives the signal output from the first feature extraction block 18 and the output of second feature extraction block 20 and produces the output audio signal of the processing circuitry 8.

The operation of the processing circuitry 8 and the functions of the various blocks introduced above will now be described in more detail with reference to FIG. 3, which is a flow chart illustrating the signal processing method according to the invention.

Briefly, the method according to the invention comprises using properties or features of the BC audio signal and a speech enhancement algorithm to reduce the amount of noise in the AC audio signal, and then using the noise-reduced AC audio signal to equalize the BC audio signal. The advantage of this method is that although the noise-reduced AC audio signal might still contain noise and/or artifacts, it can be used to improve the frequency characteristics of the BC audio signal (which generally does not contain speech artifacts) so that it sounds more intelligible.

Figure 3:
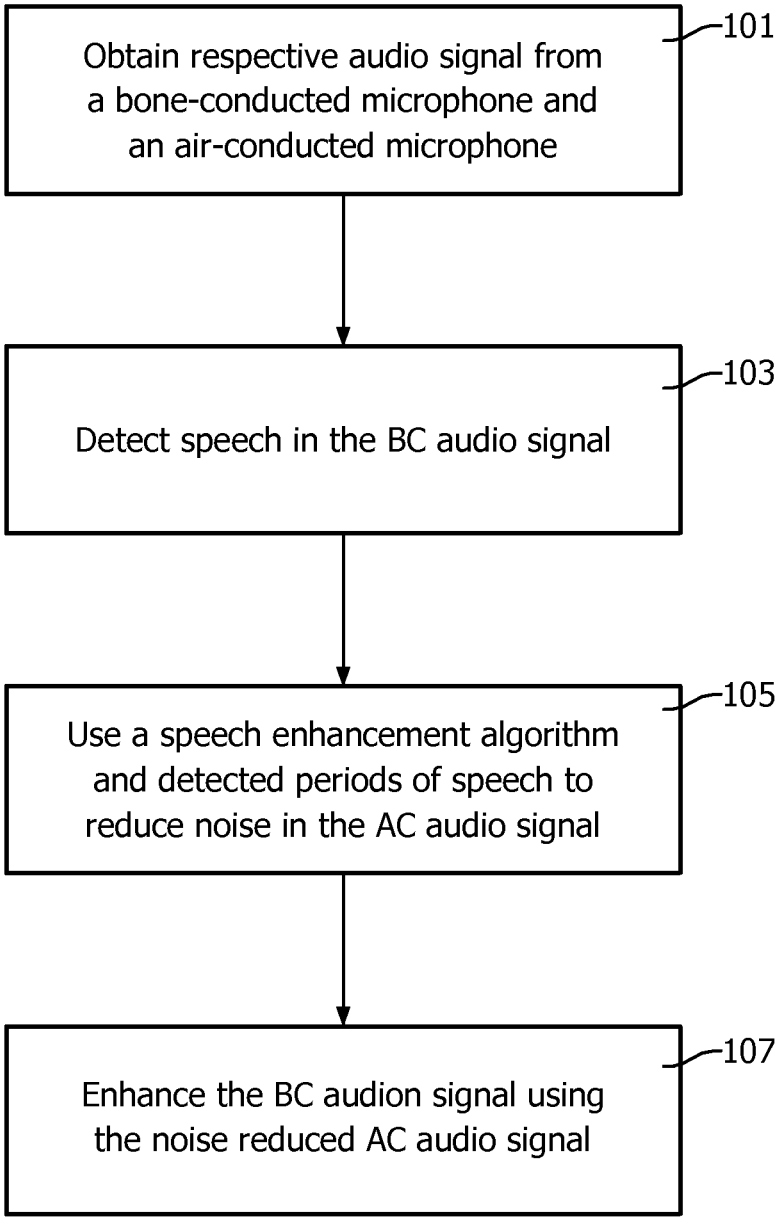
FIG. 3 is a flow chart illustrating a method for processing an audio signal from a BC microphone according to the invention.

Thus, in step 101 of FIG. 3, respective audio signals are obtained simultaneously using the BC microphone 4 and the AC microphone 6 and the signals are provided to the processing circuitry 8. In the following, it is assumed that the respective audio signals from the BC microphone 4 and AC microphone 6 are time-aligned using appropriate time delays prior to the further processing of the audio signals described below.

The speech detection block 14 processes the received BC audio signal to identify the parts of the BC audio signal that represent speech by the user of the device 2 (step 103 of FIG. 3). The use of the BC audio signal for speech detection is advantageous because of the relative immunity of the BC microphone 4 to background noise and the high SNR.

The speech detection block 14 can perform speech detection by applying a simple thresholding technique to the BC audio signal, by which periods of speech are detected when the amplitude of the BC audio signal is above a threshold value.

In further embodiments of the invention (not illustrated in the Figures), it possible to suppress noise in the BC audio signal based on minimum statistics and/or beamforming techniques (in case more than one BC audio signal is available) before speech detection is carried out.

Figure 4:
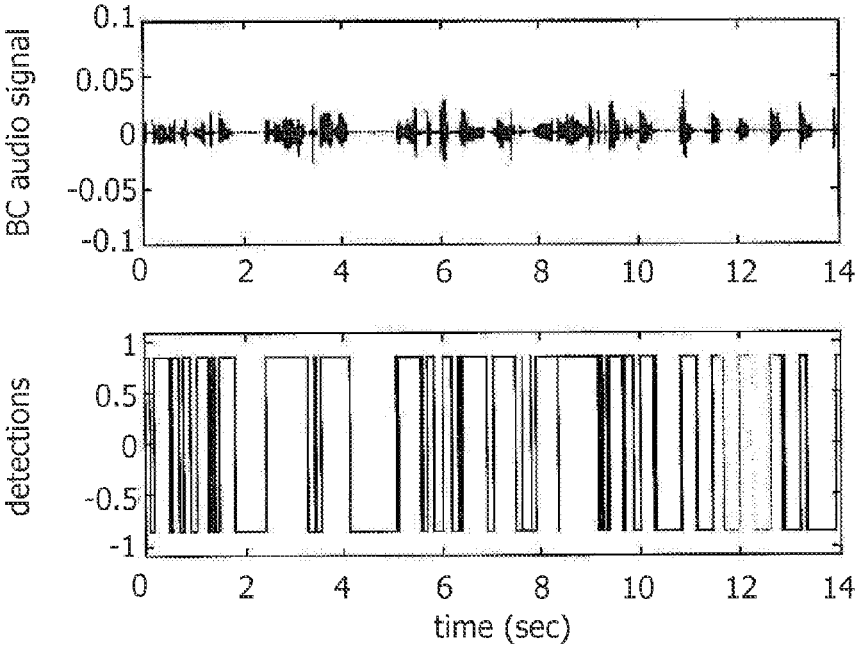
FIG. 4 is a graph showing the result of speech detection performed on a signal obtained using a BC microphone.

The graphs in FIG. 4 show the result of the operation of the speech detection block 14 on a BC audio signal.

As described above, the output of the speech detection block 14 (shown in the bottom part of FIG. 4) is provided to the speech enhancement block 16 along with the AC audio signal. Compared with the BC audio signal, the AC audio signal contains stationary and non-stationary background noise sources, so speech enhancement is performed on the AC audio signal (step 105) so that it can be used as a reference for later enhancing (equalizing) the BC audio signal. One effect of the speech enhancement block 16 is to reduce the amount of noise in the AC audio signal.

Many different types of speech enhancement algorithms are known that can be applied to the AC audio signal by block 16, and the particular algorithm used can depend on the configuration of the microphones 4, 6 in the device 2, as well as how the device 2 is to be used.

In particular embodiments, the speech enhancement block 16 applies some form of spectral processing to the AC audio signal. For example, the speech enhancement block 16 can use the output of the speech detection block 14 to estimate the noise floor characteristics in the spectral domain of the AC audio signal during non-speech periods as determined by the speech detection block 14. The noise floor estimates are updated whenever speech is not detected. In an alternative embodiment, the speech enhancement block 16 filters out the non-speech parts of the AC audio signal using the non-speech parts indicated in the output of the speech detection block 14.

In embodiments where the device 2 comprises more than one AC sensor (microphone) 6, the speech enhancement block 16 can also apply some form of microphone beamforming.

Figure 5:
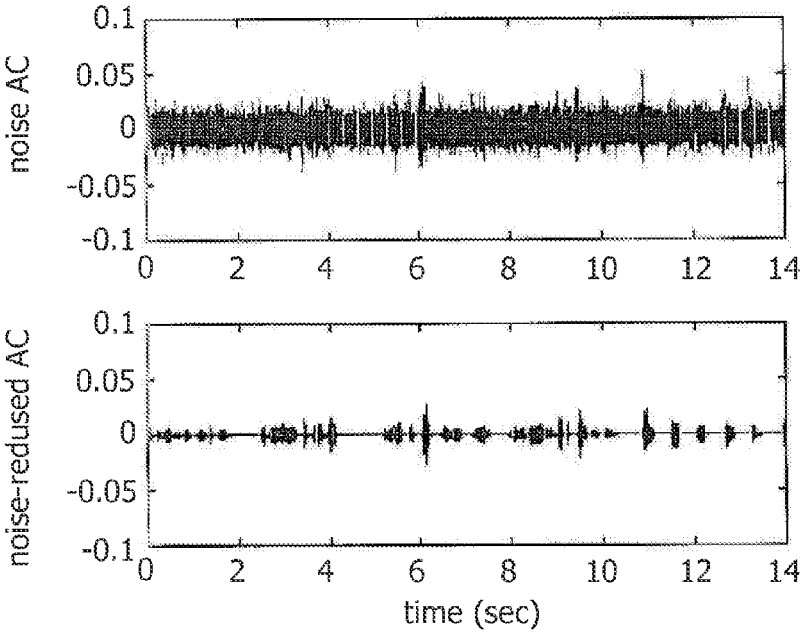
FIG. 5 is a graph showing the result of the application of a speech enhancement algorithm to a signal obtained using an AC microphone.

The top graph in FIG. 5 shows the AC audio signal obtained from the AC microphone 6 and the bottom graph in FIG. 5 shows the result of the application of the speech enhancement algorithm to the AC audio signal using the output of the speech detection block 14. It can be seen that the background noise level in the AC audio signal is sufficient to produce a SNR of approximately 0 dB and the speech enhancement block 16 applies a gain to the AC audio signal to suppress the background noise by almost 30 dB. However, it can also be seen that although the amount of noise in the AC audio signal has been significantly reduced, some artifacts remain.

Therefore, as described above, the noise-reduced AC audio signal is used as a reference signal to increase the intelligibility of (i.e. enhance) the BC audio signal (step 107).

In some embodiments of the invention, it is possible to use long-term spectral methods to construct an equalization filter, or alternatively, the BC audio signal can be used as an input to an adaptive filter which minimizes the mean-square error between the filter output and the enhanced AC audio signal, with the filter output providing an equalized BC audio signal. Yet another alternative makes use of the assumption that a finite impulse response can model the transfer function between the BC audio signal and the enhanced AC audio signal. In these embodiments, it will be appreciated that the equalizer block 22 requires the original BC audio signal in addition to the features extracted from the BC audio signal by feature extraction block 18. In this case, there will be an extra connection between the BC audio signal input line and the equalizing block 22 in the processing circuitry 8 shown in FIG. 2.

However, methods based on linear prediction can be better suited for improving the intelligibility of speech in a BC audio signal, so in preferred embodiments of the invention, the feature extraction blocks 18, 20 are linear prediction blocks that extract linear prediction coefficients from both the BC audio signal and the noise-reduced AC audio signal, which are used to construct an equalization filter, as described further below.

Linear prediction (LP) is a speech analysis tool that is based on the source-filter model of speech production, where the source and filter correspond to the glottal excitation produced by the vocal cords and the vocal tract shape, respectively. The filter is assumed to be all-pole. Thus, LP analysis provides an excitation signal and a frequency-domain envelope represented by the all-pole model which is related to the vocal tract properties during speech production.

The model is given as $$y(n) = -\sum_{k=1}^{p} a_k y(n-k) + Gu(n) \tag{1}$$

where y(n) and y(n−k) correspond to the present and past signal samples of the signal under analysis, u(n) is the excitation signal with gain G, $a_k$ represents the predictor coefficients, and p is the order of the all-pole model.

The goal of LP analysis is to estimate the values of the predictor coefficients given the audio speech samples, so as to minimize the error of the prediction $$e(n) = y(n) + \sum_{k=1}^{p} a_k y(n-k) \tag{2}$$

where the error actually corresponds to the excitation source in the source-filter model. e(n) is the part of the signal that cannot be predicted by the model since this model can only predict the spectral envelope, and actually corresponds to the pulses generated by the glottis in the larynx (vocal cord excitation).

It is known that additive white noise severely effects the estimation of LP coefficients, and that the presence of one or more additional sources in y(n) leads to the estimation of an excitation signal that includes contributions from these sources. Therefore it is important to acquire a noise-free audio signal that only contains the desired source signal in order to estimate the correct excitation signal.

The BC audio signal is such a signal. Because of its high SNR, the excitation source e can be correctly estimated using LP analysis performed by linear prediction block 18. This excitation signal e can then be filtered using the resulting all-pole model estimated by analyzing the noise-reduced AC audio signal. Because the all-pole filter represents the smooth spectral envelope of the noise-reduced AC audio signal, it is more robust to artifacts resulting from the enhancement process.

Figure 2:
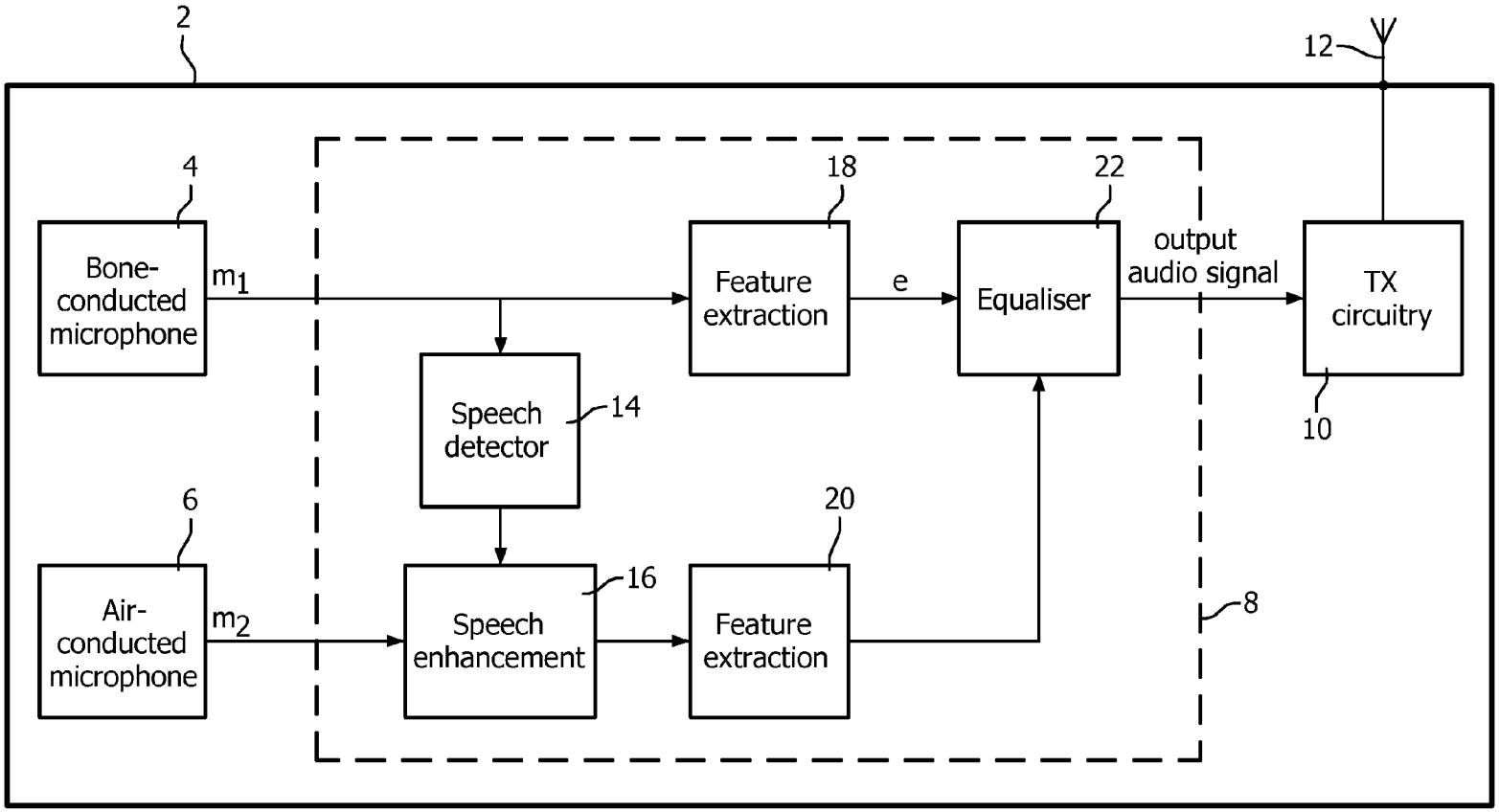
FIG. 2 is a block diagram of a device including processing circuitry according to a first embodiment of the invention.

As shown in FIG. 2, linear prediction analysis is performed on both the BC audio signal (using linear prediction block 18) and the noise-reduced AC audio signal (by linear prediction block 20). The linear prediction is performed for each block of audio samples of length 32 ms with an overlap of 16 ms. A pre-emphasis filter can also be applied to one or both of the signals prior to the linear prediction analysis. To improve the performance of the linear prediction analysis and subsequent equalization of the BC audio signal, the noise-reduced AC audio signal and BC signal can first be time-aligned (not shown) by introducing an appropriate time-delay in either audio signal. This time-delay can be determined adaptively using cross-correlation techniques.

During the current sample block, the past, present and future predictor coefficients are estimated, converted to line spectral frequencies (LSFs), smoothed, and converted back to linear predictor coefficients. LSFs are used since the linear prediction coefficient representation of the spectral envelope is not amenable to smoothing. Smoothing is applied to attenuate transitional effects during the synthesis operation.

The LP coefficients obtained for the BC audio signal are used to produce the BC excitation signal e. This signal is then filtered (equalized) by the equalizing block 22 which simply uses the all-pole filter estimated and smoothed from the noise-reduced AC audio signal $$H(z) = \frac{1}{1 + \sum_{k=1}^{p} a_k z^{-k}} \tag{3}$$

Further shaping using the LSFs of the all-pole filter can be applied to the AC all-pole filter to prevent unnecessary boosts in the effective spectrum.

If a pre-emphasis filter is applied to the signals prior to LP analysis, a de-emphasis filter can be applied to the output of H(z). A wideband gain can also be applied to the output to compensate for the wideband amplification or attenuation resulting from the emphasis filters.

Thus, the output audio signal is derived by filtering a 'clean' excitation signal e obtained from an LP analysis of the BC audio signal using an all-pole model estimated from LP analysis of the noise-reduced AC audio signal.

Figure 6:
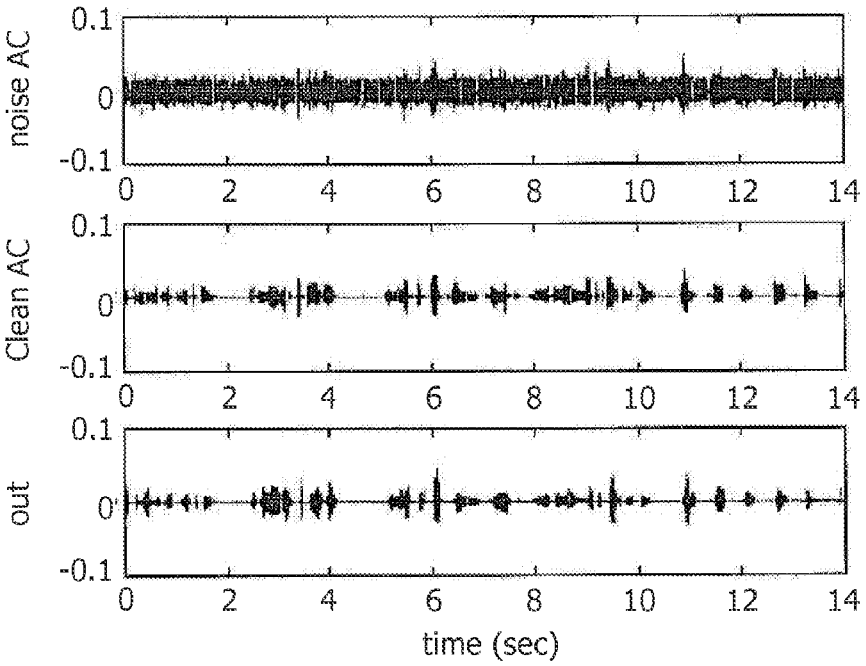
FIG. 6 is a graph showing a comparison between signals obtained using an AC microphone in a noisy and clean environment and the output of the method according to the invention.

FIG. 6 shows a comparison between the AC microphone signal in a noisy and clean environment and the output of the method according to the invention when linear prediction is used. Thus, it can be seen that the output audio signal contains considerably less artifacts than the noisy AC audio signal and more closely resembles the clean AC audio signal.

Figure 7:
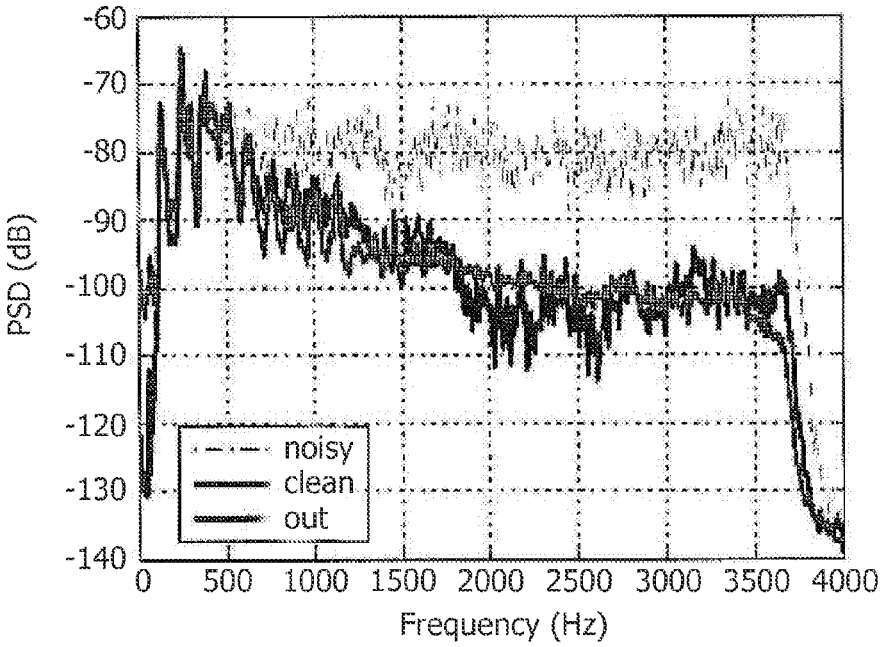
FIG. 7 is a graph showing a comparison between the power spectral densities of the three signals shown in FIG. 6.

FIG. 7 shows a comparison between the power spectral densities of the three signals shown in FIG. 6. Also here it can be seen that the output audio spectrum more closely matches the AC audio signal in a clean environment.

Figure 8:
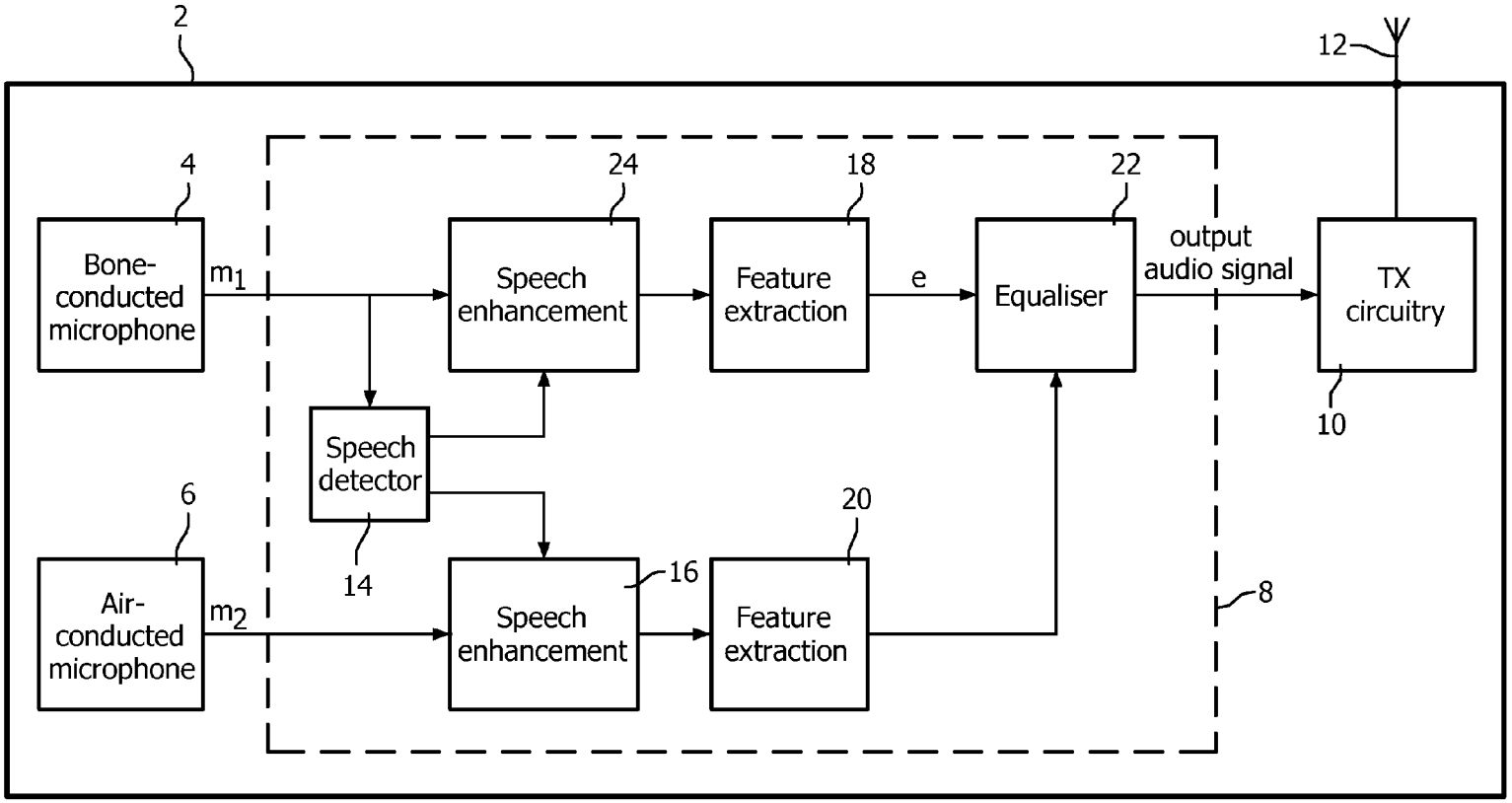
FIG. 8 is a block diagram of a device including processing circuitry according to a second embodiment of the invention.

A device 2 comprising processing circuitry 8 according to a second embodiment of the invention is shown in FIG. 8. The device 2 and processing circuitry 8 generally corresponds to that found in the first embodiment of the invention, with features that are common to both embodiments being labeled with the same reference numerals.

In the second embodiment, a second speech enhancement block 24 is provided for enhancing (reducing the noise in) the BC audio signal provided by the BC microphone 4 prior to performing linear prediction. As with the first speech enhancement block 16, the second speech enhancement block 24 receives the output of the speech detection block 14. The second speech enhancement block 24 is used to apply moderate speech enhancement to the BC audio signal to remove any noise that may leak into the microphone signal. Although the algorithms executed by the first and second speech enhancement blocks 16, 24 can be the same, the actual amount of noise suppression/speech enhancement applied will be different for the AC and BC audio signals.

Figure 9:
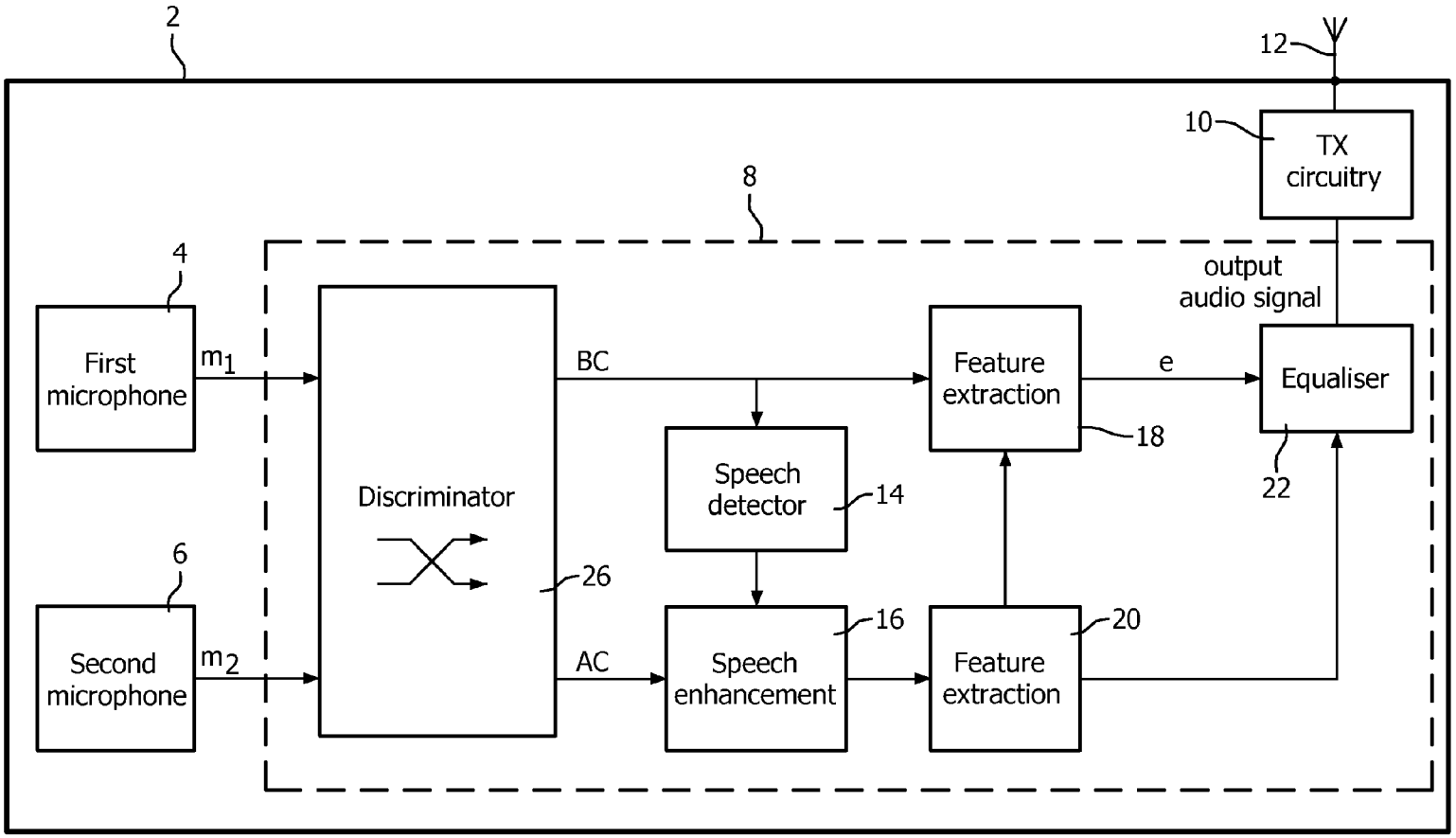
FIG. 9 is a block diagram of a device including processing circuitry according to a third embodiment of the invention.

A device 2 comprising processing circuitry 8 according to a third embodiment of the invention is shown in FIG. 9. The device 2 and processing circuitry 8 generally corresponds to that found in the first embodiment of the invention, with features that are common to both embodiments being labeled with the same reference numerals.

This embodiment of the invention can be used in devices 2 where the sensors/microphones 4, 6 are arranged in the device 2 such that either of the two sensors/microphones 4, 6 can be in contact with the user (and thus act as the BC or contact sensor or microphone), with the other sensor being in contact with the air (and thus act as the AC sensor or microphone). An example of such a device is a pendant, with the sensors being arranged on opposite faces of the pendant such that one of the sensors is in contact with the user, regardless of the orientation of the pendant. Generally, in these devices 2 the sensors 4, 6 are of the same type as either may be in contact with the user or air.

In this case, it is necessary for the processing circuitry 8 to determine which, if any, of the audio signals from the first microphone 4 and second microphone 6 corresponds to a BC audio signal and an AC audio signal.

Thus, the processing circuitry 8 is provided with a discriminator block 26 that receives the audio signals from the first microphone 4 and the second microphone 6, analyses the audio signals to determine which, if any, of the audio signals is a BC audio signal and outputs the audio signals to the appropriate branches of the processing circuitry 8. If the discriminator block 26 determines that neither microphone 4, 6 is in contact with the body of the user, then the discriminator block 26 can output one or both AC audio signals to circuitry (not shown in FIG. 9) that performs conventional speech enhancement (for example beamforming) to produce an output audio signal.

Figure 10A:
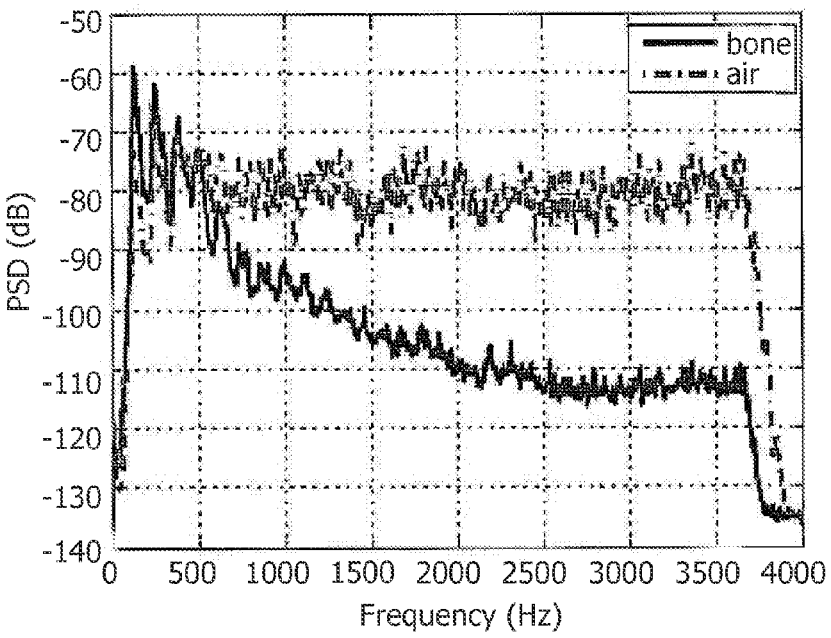
FIGS. 10A and 10B are graphs showing a comparison between the power spectral densities between signals obtained from a BC microphone and an AC microphone with and without background noise respectively.
Figure 10B:
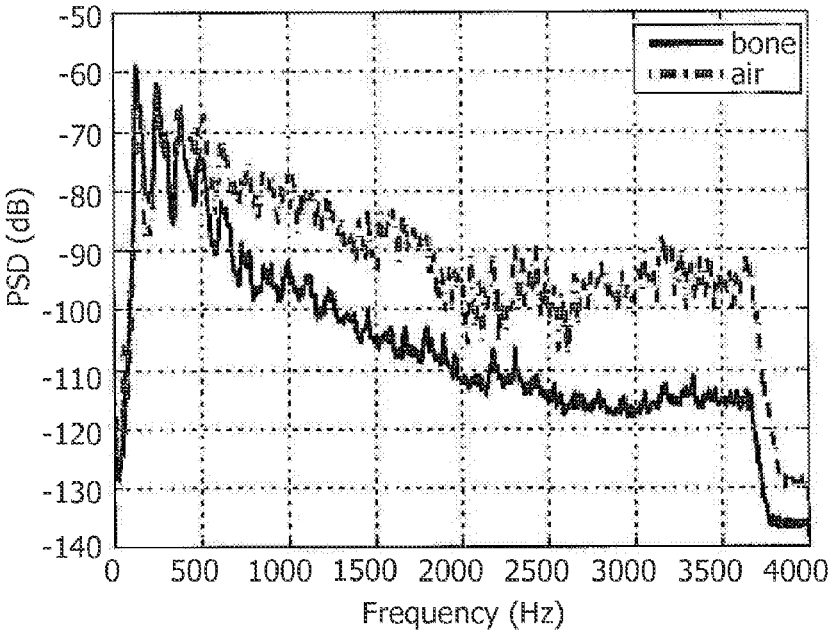

It is known that high frequencies of speech in a BC audio signal are attenuated due to the transmission medium (for example frequencies above 1 kHz), which is demonstrated by the graphs in FIG. 9 that show a comparison of the power spectral densities of BC and AC audio signals in the presence of background diffuse white noise (FIG. 10A) and without background noise (FIG. 10B). This property can therefore be used to differentiate between BC and AC audio signals, and in one embodiment of the discriminator block 26, the spectral properties of each of the audio signals are analyzed to detect which, if any, microphone 4, 6 is in contact with the body.

However, a difficulty arises from the fact that the two microphones 4, 6 might not be calibrated, i.e. the frequency response of the two microphones 4, 6 might be different. In this case, a calibration filter can be applied to one of the microphones before proceeding with the discriminator block 26 (not shown in the Figures). Thus, in the following, it can be assumed that the responses are equal up to a wideband gain, i.e. the frequency responses of the two microphones have the same shape.

In the following operation, the discriminator block 26 compares the spectra of the audio signals from the two microphones 4, 6 to determine which audio signal, if any, is a BC audio signal. If the microphones 4, 6 have different frequency responses, this can be corrected with a calibration filter during production of the device 2 so the different microphone responses do not affect the comparisons performed by the discriminator block 26.

Even if this calibration filter is used, it is still necessary to account for some gain differences between AC and BC audio signals as the intensity of the AC and BC audio signals is different, in addition to their spectral characteristics (in particular the frequencies above 1 kHz).

Thus, the discriminator block 26 normalizes the spectra of the two audio signals above the threshold frequency (solely for the purpose of discrimination) based on global peaks found below the threshold frequency, and compares the spectra above the threshold frequency to determine which, if any, is a BC audio signal. If this normalization is not performed, then, due to the high intensity of a BC audio signal, it might be determined that the power in the higher frequencies is still higher in the BC audio signal than in the AC audio signal, which would not be the case.

In the following, it is assumed that any calibration required to account for differences in the frequency response of the microphones 4, 6 has been performed. In a first step, the discriminator block 26 applies an N-point fast Fourier transform (FFT) to the audio signals from each microphone 4, 6 as follows:

$$M_1(\omega)=\mathrm{FFT}\{m_1(t)\} \tag{4}$$

$$M_2(\omega)=\mathrm{FFT}\{m_2(t)\} \tag{5}$$

producing N frequency bins between $\omega=0$ radians (rad) and $\omega=2\pi f_s$ rad where $f_s$ is the sampling frequency in Hertz (Hz) of the analog-to-digital converters which convert the analog microphone signals to the digital domain. Apart from the first N/2+1 bins including the Nyquist frequency $\pi f_s$, the remaining bins can be discarded. The discriminator block 26 then uses the result of the FFT on the audio signals to calculate the power spectrum of each audio signal.

Then, the discriminator block 26 finds the value of the maximum peak of the power spectrum among the frequency bins below a threshold frequency $\omega_c$:

$$p_1 = \max_{0<\omega<\omega_c} |M_1(\omega)|^2 \tag{6}$$

$$p_2 = \max_{0<\omega<\omega_c} |M_2(\omega)|^2 \tag{7}$$

and uses the maximum peaks to normalize the power spectra of the audio signals above the threshold frequency $\omega_c$. The threshold frequency $\omega_c$, is selected as a frequency above which the spectrum of the BC audio signal is generally attenuated relative to an AC audio signal. The threshold frequency $\omega_c$ can be, for example, 1 kHz. Each frequency bin contains a single value, which, for the power spectrum, is the magnitude squared of the frequency response in that bin.

Alternatively, the discriminator block 26 can find the summed power spectrum below $\omega_c$ for each signal, i.e.

$$p_1 = \sum_{\omega=0}^{\omega_c} |M_1(\omega)|^2 \tag{8}$$

$$p_2 = \sum_{\omega=0}^{\omega_c} |M_2(\omega)|^2 \tag{9}$$

and can normalize the power spectra of the audio signals above the threshold frequency $\omega_c$ using the summed power spectra.

As the low frequency bins of an AC audio signal and a BC audio signal should contain roughly the same low-frequency information, the values of $p_1$ and $p_2$ are used to normalize the signal spectra from the two microphones 4, 6, so that the high frequency bins for both audio signals can be compared (where discrepancies between a BC audio signal and AC audio signal are expected to be found) and a potential BC audio signal identified.

The discriminator block 26 then compares the power between the spectrum of the signal from the first microphone 4 and the spectrum of the signal from the normalized second microphone 6 in the upper frequency bins $$\sum_{\omega>\omega_c} |M_1(\omega)|^2 \langle = \rangle p_1/(p_2+\epsilon) \sum_{\omega>\omega_c} |M_2(\omega)|^2 \tag{10}$$

where $\epsilon$ is a small constant to prevent division by zeros, and $p_1/(p_2+\epsilon)$ represents the normalization of the spectra of the second audio signal (although it will be appreciated that the normalization could be applied to the first audio signal instead).

Provided that the difference between the powers of the two audio signals is greater than a predetermined amount that depends on the location of the bone-conducting sensor and can be determined experimentally, the audio signal with the largest power in the normalized spectrum above $\omega_c$ is an audio signal from an AC microphone, and the audio signal with the smallest power is an audio signal from a BC microphone. The discriminator block 26 then outputs the audio signal determined to be a BC audio signal to the upper branch of the processing circuitry 8 (i.e. the branch that includes the speech detection block 14 and feature extraction block 18) and the audio signal determined to be an AC audio signal to the lower branch of the processing circuitry 8 (i.e. the branch that includes the speech enhancement block 16).

However, if the difference between the powers of the two audio signals is less than the predetermined amount, then it is not possible to determine positively that either one of the audio signals is a BC audio signal (and it may be that neither microphone 4, 6 is in contact with the body of the user). In that case, the processing circuitry 8 can treat both audio signals as AC audio signals and process them using conventional techniques, for example by combining the AC audio signals using beamforming techniques.

It will be appreciated that, instead of calculating the modulus squared in the above equations, it is possible to calculate the modulus values.

It will also be appreciated that alternative comparisons between the power of the two signals can be made using a bounded ratio so that uncertainties can be accounted for in the decision making. For example, a bounded ratio of the powers in frequencies above the threshold frequency can be determined:

$$\frac{p_1 - p_2}{p_1 + p_2} \tag{11}$$

with the ratio being bounded between −1 and 1, with values close to 0 indicating uncertainty in which microphone, if any, is a BC microphone.

Figure 11:
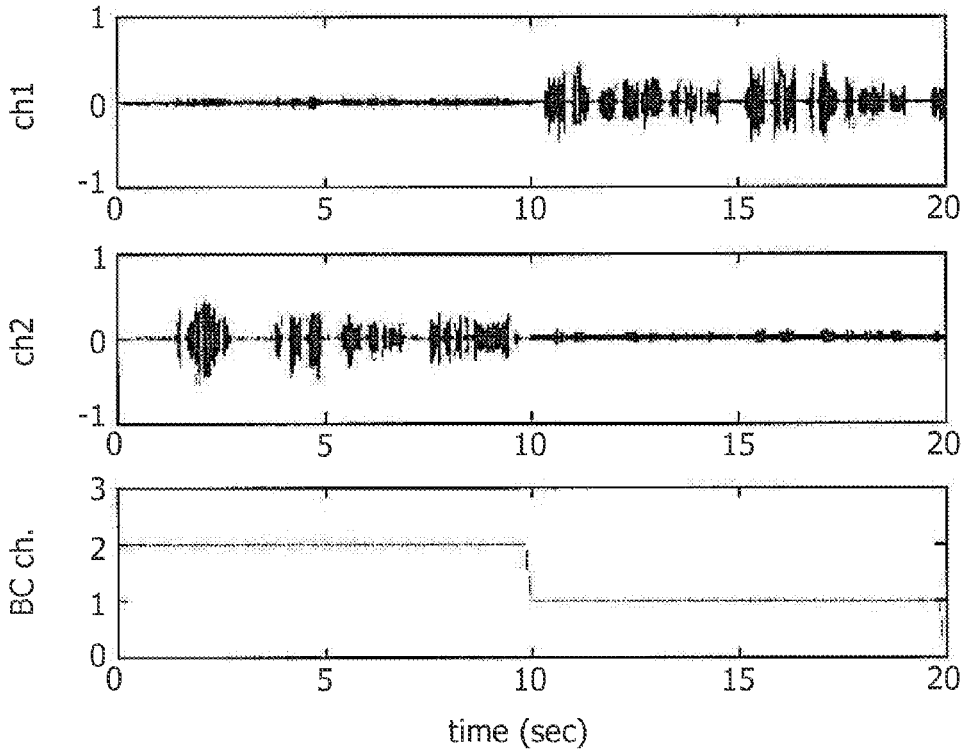
FIG. 11 is a graph showing the result of the action of a BC/AC discriminator module in the processing circuitry according to the third embodiment.

The graph in FIG. 11 illustrates the operation of the discriminator block 26 described above during a test procedure. In particular, during the first 10 seconds of the test, the second microphone is in contact with a user (so it provides a BC audio signal) which is correctly identified by the discriminator block 26 (as shown in the bottom graph). In the next 10 seconds of the test, the first microphone is in contact with the user instead (so it then provides a BC audio signal) and this is again correctly identified by the discriminator block 26.

Figure 12:
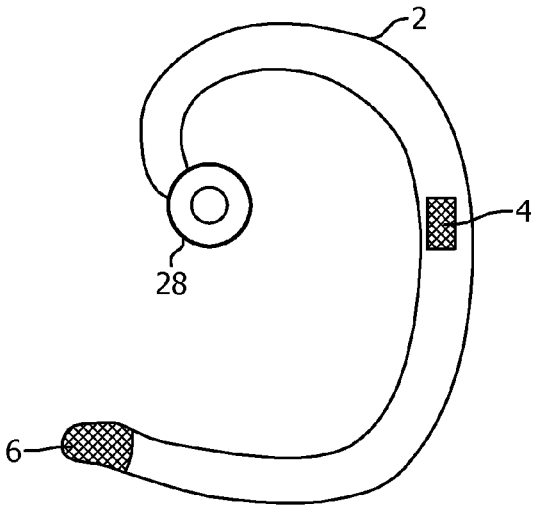
FIGS. 12, 13 and 14 show exemplary devices incorporating two microphones that can be used with the processing circuitry according to the invention.
Figure 13:
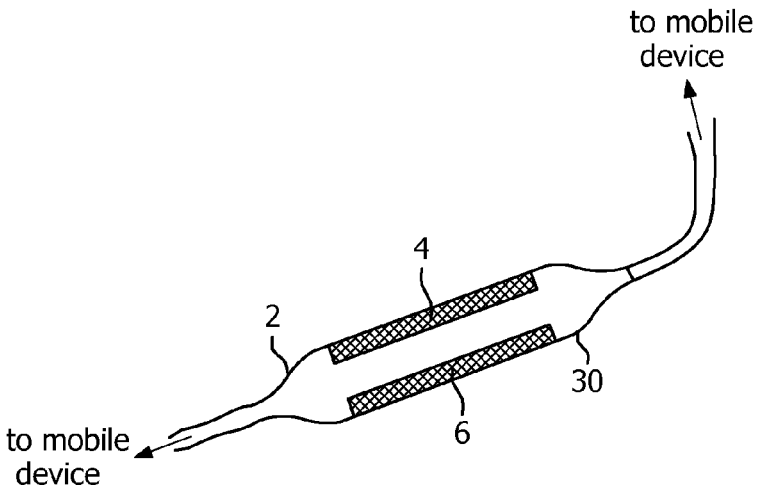
Figure 14:
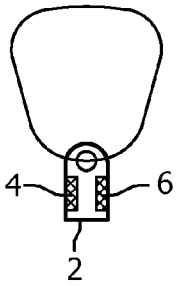

FIGS. 12, 13 and 14 show exemplary devices 2 incorporating two microphones that can be used with the processing circuitry 8 according to the invention.

The device 2 shown in FIG. 12 is a wireless headset that can be used with a mobile telephone to provide hands-free functionality. The wireless headset is shaped to fit around the user's ear and comprises an earpiece 28 for conveying sounds to the user, an AC microphone 6 that is to be positioned proximate to the user's mouth or cheek for providing an AC audio signal, and a BC microphone 4 positioned in the device 2 so that it is in contact with the head of the user (preferably somewhere around the ear) and it provides a BC audio signal.

FIG. 13 shows a device 2 in the form of a wired hands-free kit that can be connected to a mobile telephone to provide hands-free functionality. The device 2 comprises an earpiece (not shown) and a microphone portion 30 comprising two microphones 4, 6 that, in use, is placed proximate to the mouth or neck of the user. The microphone portion is configured so that either of the two microphones 4, 6 can be in contact with the neck of the user, which means that the third embodiment of the processing circuitry 8 described above that includes the discriminator block 26 would be particularly useful in this device 2.

FIG. 14 shows a device 2 in the form of a pendant that is worn around the neck of a user. Such a pendant might be used in a mobile personal emergency response system (MPERS) device that allows a user to communicate with a care provider or emergency service.

The two microphones 4, 6 in the pendant 2 are arranged so that the pendant is rotation-invariant (i.e. they are on opposite faces of the pendant 2), which means that one of the microphones 4, 6 should be in contact with the user's neck or chest. Thus, the pendant 2 requires the use of the processing circuitry 8 according to the third embodiment described above that includes the discriminator block 26 for successful operation.

It will be appreciated that any of the exemplary devices 2 described above can be extended to include more than two microphones (for example the cross-section of the pendant 2 could be triangular (requiring three microphones, one on each face) or square (requiring four microphones, one on each face)). It is also possible for a device 2 to be configured so that more than one microphone can obtain a BC audio signal. In this case, it is possible to combine the audio signals from multiple AC (or BC) microphones prior to input to the processing circuitry 8 using, for example, beamforming techniques, to produce an AC (or BC) audio signal with an improved SNR. This can help to further improve the quality and intelligibility of the audio signal output by the processing circuitry 8.

Those skilled in the art will be aware of suitable microphones that can be used as AC microphones and BC microphones. For example, one or more of the microphones can be based on MEMS technology.

It will be appreciated that the processing circuitry 8 shown in FIGS. 2, 8 and 9 can be implemented as a single processor, or as multiple interconnected dedicated processing blocks. Alternatively, it will be appreciated that the functionality of the processing circuitry 8 can be implemented in the form of a computer program that is executed by a general purpose processor or processors within a device. Furthermore, it will be appreciated that the processing circuitry 8 can be implemented in a separate device to a device housing BC and/or AC microphones 4, 6, with the audio signals being passed between those devices.

It will also be appreciated that the processing circuitry 8 (and discriminator block 26, if implemented in a specific embodiment), can process the audio signals on a block-by-block basis (i.e. processing one block of audio samples at a time). For example, in the discriminator block 26, the audio signals can be divided into blocks of N audio samples prior to the application of the FFT. The subsequent processing performed by the discriminator block 26 is then performed on each block of N transformed audio samples. The feature extraction blocks 18, 20 can operate in a similar way.

There is therefore provided a system and method for producing an audio signal representing the speech of a user from an audio signal obtained using a BC microphone that can be used in noisy environments and that does not require the user to train the algorithm before use.

While the invention has been illustrated and described in detail in the drawings and foregoing description, such illustration and description are to be considered illustrative or exemplary and not restrictive; the invention is not limited to the disclosed embodiments.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method of generating a signal representing the speech of a user, the method comprising:

obtaining a first audio signal representing the speech of the user using a sensor in contact with the user;

obtaining a second audio signal using an air conduction sensor, the second audio signal representing the speech of the user and including noise from the environment around the user;

detecting periods of speech in the first audio signal;

applying a speech enhancement algorithm to the second audio signal to reduce the noise in the second audio signal, the speech enhancement algorithm using the detected periods of speech in the first audio signal;

equalizing the first audio signal using the noise-reduced second audio signal to produce an output audio signal representing the speech of the user, the equalizing includes performing linear prediction analysis on both the first audio signal and the noise-reduced second audio signal to construct an equalization filter, wherein the performing linear prediction analysis further includes:

(i) estimating linear prediction coefficients for both the first audio signal and the noise-reduced second audio signal;

(ii) using the linear prediction coefficients for the first audio signal to produce an excitation signal for the first audio signal;

(iii) using the linear prediction coefficients for the noise-reduced second audio signal to construct a frequency domain envelope; and (iv) equalizing the excitation signal for the first audio signal using the frequency domain envelope.

2. The method as claimed in claim 1, wherein detecting periods of speech in the first audio signal comprises detecting parts of the first audio signal where the amplitude of the audio signal is above a threshold value.

3. The method as claimed in claim 1, wherein applying a speech enhancement algorithm comprises applying spectral processing to the second audio signal.

4. The method as claimed in claim 1, wherein applying a speech enhancement algorithm to reduce the noise in the second audio signal comprises using the detected periods of speech in the first audio signal to estimate the noise floors in the spectral domain of the second audio signal.

5. The method as claimed in claim 1, wherein equalizing the first audio signal comprises (i) using long-term spectral methods to construct an equalization filter, or (ii) using the first audio signal as an input to an adaptive filter that minimizes the mean-square error between the filter output and the noise-reduced second audio signal.

6. The method as claimed in claim 1, wherein prior to the step of equalizing, the method further comprises the step of applying a speech enhancement algorithm to the first audio signal to reduce the noise in the first audio signal, the speech enhancement algorithm making use of the detected periods of speech in the first audio signal, and wherein the step of equalizing comprises equalizing the noise-reduced first audio signal using the noise-reduced second audio signal to produce the output audio signal representing the speech of the user.

7. The method as claimed in claim 1, further comprising:

obtaining a third audio signal using a second air conduction sensor, the third audio signal representing the speech of the user and including noise from the environment around the user; and using a beamforming technique to combine the second audio signal and the third audio signal and produce a combined audio signal;

and wherein the step of applying a speech enhancement algorithm comprises applying the speech enhancement algorithm to the combined audio signal to reduce the noise in the combined audio signal, the speech enhancement algorithm using the detected periods of speech in the first audio signal.

8. The method as claimed in claim 1, further comprising:

obtaining a fourth audio signal representing the speech of a user using a second sensor in contact with the user; and using a beamforming technique to combine the first audio signal and the fourth audio signal and produce a second combined audio signal;

and wherein the step of detecting periods of speech comprises detecting periods of speech in the second combined audio signal.

9. A non-transitory computer readable medium carrying a computer program for controlling one or more processors to perform the method as claimed in claim 1.

10. A device for use in generating an audio signal representing the speech of a user, the device comprising:

processing circuitry that is configured to:

receive a first audio signal representing the speech of the user from a sensor in contact with the user;

receive a second audio signal from an air conduction sensor, the second audio signal representing the speech of the user and including noise from the environment around the user;

detect periods of speech in the first audio signal;

apply a speech enhancement algorithm to the second audio signal to reduce the noise in the second audio signal, the speech enhancement algorithm using the detected periods of speech in the first audio signal; and equalize the first audio signal using the noise-reduced second audio signal to produce an output audio signal representing the speech of the user;

wherein the processing circuitry is configured to equalize the first audio signal by performing linear prediction analysis on both the first audio signal and the noise-reduced second audio signal to construct an equalization filter, performing the linear prediction analysis including:

(i) estimating linear prediction coefficients for both the first audio signal and the noise reduced second audio signal;

(ii) using the linear prediction coefficients for the first audio signal to produce an excitation signal for the first audio signal;

(iii) using the linear prediction coefficients for the noise-reduced audio signal to construct a frequency domain envelope; and (iv)equalizing the excitation signal for the first audio signal using the frequency domain envelope.

11. The device as claimed in claim 10, the device further comprising:

a contact sensor that is configured to contact the body of the user when the device is in use and to produce the first audio signal; and an air-conduction sensor that is configured to produce the second audio signal.

12. A device for generating an audio signal representing the speech of a user, the device comprising:

a processor configured to:

receive a first audio signal representing the speech of the user from a sensor in contact with the user;

receive a second audio signal representing the speech of the user including noise from an environment around the user;

detect periods of speech in the first audio signal;

apply a speech enhancement algorithm to the second audio signal to reduce the noise in the second audio signal; and equalize the first audio signal using the noise-reduced second audio signal to produce and output an audio signal representing the speech of the user, the equalizing including:

(i) estimate linear prediction coefficients for both the first audio signal and the noise reduced second audio signal;

(ii) use the linear prediction coefficients for the first audio signal to produce an excitation signal for the first audio signal; and (iii) use the linear prediction coefficients for the noise-reduced audio signal to construct a frequency domain envelope; and (iv) equalize the excitation signal for the first audio signal using the frequency domain envelope.

13. The device as claimed in claim 12, wherein the processor is further configured to:

perform linear prediction analysis on the first audio signal and the second audio signal to construct an equalization filter.

14. A device for generating an audio signal representing the speech of a user, the device comprising:

a processor configured to:

receive a first audio signal representing the speech of the user from a sensor in contact with the user;

receive a second audio signal representing the speech of the user including noise from an environment around the user;

detect periods of speech in the first audio signal;

apply a speech enhancement algorithm to the second audio signal to reduce the noise in the second audio signal, wherein the speech enhancement algorithm analyzes the first and noise-reduced second audio signals to generate an excitation signal for the first audio signal and a frequency domain envelope for the noise-reduced audio signal; and equalize the excitation signal for the first audio signal using the frequency domain envelope and the noise-reduced second audio signal to produce and output an audio signal representing the speech of the user.

15. A device for generating an audio signal representing the speech of a user, the device comprising:

a processor configured to:

receive a first audio signal representing the speech of the user from a sensor in contact with the user;

receive a second audio signal representing the speech of the user including noise from an environment around the user;

detect periods of speech in the first audio signal;

apply a speech enhancement algorithm to the second audio signal to reduce the noise in the second audio signal;

equalize the first audio signal using the noise-reduced second audio signal to produce and output an audio signal representing the speech of the user; and analyze the first and noise-reduced second audio signals by estimating linear prediction coefficients for the first and noise-reduced second audio signals, the linear prediction coefficients being used to generate the excitation signal and the frequency domain envelope.

* * * * *